US008047619B2

(12) United States Patent
Amstutz et al.

(10) Patent No.: US 8,047,619 B2
(45) Date of Patent: Nov. 1, 2011

(54) SECURITY DISPLAY CASE

(75) Inventors: Douglas D. Amstutz, Muskegon, MI (US); Edward J. Bacheller, Muskegon, MI (US); Richard J. Yager, Muskegon, MI (US)

(73) Assignee: Amstore Corporation, Coopersville, MI (US)

( * ) Notice: Subject to any disclaimer, the term of this patent is extended or adjusted under 35 U.S.C. 154(b) by 867 days.

(21) Appl. No.: 12/017,674

(22) Filed: Jan. 22, 2008

(65) Prior Publication Data

US 2008/0174215 A1 Jul. 24, 2008

Related U.S. Application Data

(60) Provisional application No. 60/885,947, filed on Jan. 22, 2007.

(51) Int. Cl.
*A47F 3/00* (2006.01)

(52) U.S. Cl. ..... 312/117; 312/138.1; 312/319.8

(58) Field of Classification Search ..... 312/114, 312/117, 138.1, 294, 304, 306, 319.5, 350, 312/293.2, 118, 126, 128, 319.6–319.8; 292/259 R
See application file for complete search history.

(56) References Cited

U.S. PATENT DOCUMENTS

| | | | | | |
|---|---|---|---|---|---|
| 145,378 | A | | 12/1873 | Wilkins | |
| 328,475 | A | | 10/1885 | Ford | |
| 542,745 | A | | 7/1895 | Hoare | |
| 944,513 | A | * | 12/1909 | Selden | 312/216 |
| 1,292,550 | A | * | 1/1919 | Wheary | 312/216 |
| 1,399,680 | A | * | 12/1921 | Airgood | 220/327 |
| 1,441,763 | A | | 1/1923 | Stinson | |
| 1,544,218 | A | | 6/1925 | Champion | |
| 1,573,579 | A | * | 2/1926 | Ross | 292/145 |
| 1,831,847 | A | * | 11/1931 | Derman | 312/227 |
| 1,949,954 | A | | 3/1934 | Culler et al. | |
| 1,990,300 | A | | 2/1935 | Miller | |
| 2,068,591 | A | | 1/1937 | Bennett | |
| 2,201,948 | A | | 5/1940 | Watkins | |
| 2,284,531 | A | | 5/1942 | Miller et al. | |
| 2,456,429 | A | | 12/1948 | Parsons | |
| 2,569,254 | A | | 9/1951 | Page | |
| 2,576,888 | A | | 11/1951 | Padgett | |
| 2,655,419 | A | | 10/1953 | Achs | |

(Continued)

FOREIGN PATENT DOCUMENTS

EP 0 521 728 1/1993

(Continued)

*Primary Examiner* — James O Hansen
*Assistant Examiner* — Matthew Ing
(74) *Attorney, Agent, or Firm* — Warner Norcross & Judd LLP

(57) ABSTRACT

A security display case including an enclosure having a security portion and a display portion, a platform moveable from the security portion to the display portion, a security member that secures the security portion, a gas spring that moves the platform from the security portion to the display portion, and a stabilizing assembly that stabilizes the moving platform. Optionally, the gas spring is paired with another gas spring so that the lateral forces of the springs are substantially cancelled, and the vertical forces are combined to move the platform. The stabilizing assembly can be a rack and pinion gear including at least two pinion gears engaged by a common member which synchronizes rotation of the gears to prevent binding of the platform as it is moved. The security member can include doors that fold over the security portion and which are engaged at their edges by a common locking member.

4 Claims, 11 Drawing Sheets

U.S. PATENT DOCUMENTS

| | | | | | |
|---|---|---|---|---|---|
| 2,687,934 | A | | 8/1954 | Gipple | |
| 2,688,527 | A | | 9/1954 | Wright | |
| 2,739,730 | A | | 3/1956 | Jonas | |
| 3,805,962 | A | | 4/1974 | Bendiksen | |
| 3,896,742 | A | | 7/1975 | Ferraro | |
| 4,022,137 | A | | 5/1977 | Chiu | |
| 4,045,008 | A | | 8/1977 | Bauer | |
| 4,369,717 | A | | 1/1983 | Bollier | |
| 4,429,911 | A | * | 2/1984 | O'Neal et al. | 292/259 R |
| 4,755,011 | A | | 7/1988 | Seroka et al. | |
| 4,764,146 | A | * | 8/1988 | Auer et al. | 446/279 |
| 4,929,862 | A | | 5/1990 | Hamilton et al. | |
| 4,942,328 | A | | 7/1990 | Price | |
| 5,129,611 | A | | 7/1992 | Grover et al. | |
| 5,165,768 | A | | 11/1992 | Zarrabi et al. | |
| 5,201,530 | A | | 4/1993 | Kelch et al. | |
| 5,273,352 | A | * | 12/1993 | Saper | 312/7.2 |
| 5,295,743 | A | | 3/1994 | Moulton et al. | |
| 5,450,800 | A | | 9/1995 | Leonard | |
| 5,483,905 | A | | 1/1996 | Johansson | |
| 5,524,977 | A | | 6/1996 | Orawski | |
| 5,638,977 | A | * | 6/1997 | Bianchi | 220/314 |
| 5,732,919 | A | * | 3/1998 | Rosen et al. | 248/274.1 |
| 5,733,021 | A | | 3/1998 | O=Neill et al. | |
| 5,758,936 | A | | 6/1998 | Baughan | |
| 5,791,749 | A | | 8/1998 | O=Neill et al. | |
| 5,820,233 | A | | 10/1998 | Hahn | |
| 5,853,235 | A | | 12/1998 | Barnes | |
| 6,102,355 | A | | 8/2000 | Rood | |
| 6,361,131 | B1 | | 3/2002 | Powell, Jr. | |
| 6,540,311 | B2 | * | 4/2003 | Canedy et al. | 312/114 |
| 6,764,145 | B2 | | 7/2004 | Canedy et al. | |
| 6,802,576 | B2 | * | 10/2004 | Shepherd | 312/117 |
| 6,832,822 | B2 | | 12/2004 | Canedy et al. | |
| 6,851,770 | B2 | | 2/2005 | Canedy et al. | |
| 7,073,642 | B2 | | 7/2006 | Keller et al. | |
| 2001/0011679 | A1 | * | 8/2001 | Noblet et al. | 232/45 |
| 2005/0184546 | A1 | * | 8/2005 | Kunz et al. | 296/26.01 |
| 2005/0255737 | A1 | * | 11/2005 | Bella et al. | 439/352 |
| 2005/0274303 | A1 | * | 12/2005 | Scherrer et al. | 108/144.11 |

FOREIGN PATENT DOCUMENTS

| | | |
|---|---|---|
| FR | 2 619 695 | 3/1989 |
| GB | 668942 | 3/1952 |
| JP | 52-007700 | 1/1977 |

* cited by examiner

SECURITY DISPLAY CASE

This application claims priority benefit to U.S. Provisional Application 60/885,947, filed Jan. 22, 2007, which is incorporated by reference in its entirety.

BACKGROUND OF THE INVENTION

The present invention relates to display cases, and more particularly, to display cases having a platform on which valuables are supported, the platform being moveable between a display position and a secure position.

A variety of display cases are used in the retail industry to exhibit valuable items such as jewelry, electronic devices, coins and antiques. Conventional display cases include a display section encased with one or more glass windows to enable viewing of the items displayed therein. As expected, these glass windows only offer a low level of security because a criminal can easily break the windows and steal the valuable items stored in the case. Accordingly, many stores remove the valuable items from the display case after store hours and secure those items in a safer device, such as a locked safe. Of course, this relocation requires additional time and labor, and thus increases cost. In addition, with the routine movement of the valuable items, stores frequently experience inventory loss and internal (employee) theft.

There have been several attempts to address the above problems. One such attempt is provided in U.S. Pat. No. 6,851,770 to Canedy et al, in which a display case is provided with a platform that supports valuable items. The platform is moved vertically between a display section of the case and a secured, lower section of the display case by a highly specific linear actuator. This linear actuator is secured to the platform, produces force to move the platform, and has a range of motion—from a retracted position to an extended position—that is limited to a single, unchanging straight line axis in either of two directions (up or down). Canedy explains that its linear actuator is a powered jack, a screw type actuator, a powered rack and pinion actuator, or a chain and sprocket actuator, but excludes any type of actuator that moves or extends in any manner off the straight line axis, for example, a scissor lift mechanism, or any device that moves through space under the platform both vertically and laterally. Canedy also excludes any actuator that is connected at pivot points to the platform, or that exerts lateral forces on the platform during operation, claiming that this causes "binding" of the platform with the sides of the display case.

Although previous display case constructions provide a way to move a platform from a display section to a secured section of a display case, they suffer a number of shortcomings. First, conventional actuators require notable power—either manual or electrical—to move the platform. This can increase power usage within a store, or needlessly consume labor time while employees move the platform. Second, previous constructions, such as that in Canedy, can bind against the side walls of the case where the platform is tightly fitted within the case and/or where the platform is unevenly loaded. This can needlessly result in the platform becoming lodged in one position, the powered actuator overheating and failing, or increased wear on the actuator. Further, where the platform is unevenly loaded, it can be prone to teetering or movement even when in the display position simply by someone bumping the display case. This can cause unintended movement of items on the platform, which can require an employee to re-orient those items.

SUMMARY OF THE INVENTION

The present invention provides a security display case including an enclosure having a security portion and a display portion, a platform moveable from the security portion to the display portion, a security member that secures the security portion, at least one gas spring actuator that moves the platform from the security portion to the display portion, and a stabilizing assembly that stabilizes the platform.

In one embodiment, the gas spring actuator, also referred to herein as a shock, can be pivotally joined with the platform and/or the security portion. The gas spring can be configured to generate a force to raise the platform from the security portion toward the display portion. In so doing, the gas spring can pivot from substantially horizontal to an angle relative to horizontal. Optionally, the case can include a second gas spring that is positioned in an opposing relationship to the first gas spring. With this configuration, the lateral forces generated by the shocks substantially can cancel one another out; however, the vertical forces provided by the shocks can combine to quickly and efficiently raise the platform from the security portion toward the display portion.

In another embodiment, the stabilizing mechanism can include a rack and pinion gear assembly, which is joined with the security portion and the platform. The rack and pinion gear assembly can include multiple pinion gears that engage the corresponding rack gears. The pinion gears can be synchronized with one another in several ways. In one, pinion gears on opposite sides of the platform can be mounted on a common axle so that they rotate simultaneously. In another, two or more pinion gears, for example, on one side of the platform, can be connected via a synchronizing member, for example, a belt, a web, a cord, a chain or a wire. The belt can ensure that the pinion gears rotate synchronously. As a result, the same side and an opposite side of the platform with synchronized gears raises in a leveled manner, and is resistant to tipping or teetering, which could upset or topple items placed on the platform. Further optionally, the stabilizing mechanism can include a tension member, which contacts the synchronizing member and induces a tension in the synchronizing member so that it does not slip relative to other components.

In a further embodiment, the security member can include two or more opposing doors that fold inward toward one another to close over the security portion. The doors can include edges that are adjacent and face one another when the doors are closed.

In yet another embodiment, an aperture can be included in the enclosure and/or security portion. This aperture can be aligned with the edges of the doors. A locking member, such as a bar, can be configured to slide through the aperture and engage each of the door edges so that the doors remain in a locked position, or to simply store the locking member when the platform is raised to the display portion. Optionally, the platform of the case may include a guide member, such as a bracket or a channel, to assist in centering the locking member relative to the aperture and ease insertion of the member into the aperture. Further optionally, the guide member may include a ramped surface to further direct the locking member toward the aperture.

In yet a further embodiment, the doors can include upper and lower sides. The lower sides can include mirrors so that when the doors are opened, the mirrors provide enhanced viewing of the platform and any items thereon.

In another further embodiment, the doors can include securing devices, such as magnets, which mate with corresponding securing devices, such as metal pieces, which are joined with the display portion to hold the doors in an open configuration. Optionally, the securing devices can be included on the upper sides of the doors.

In yet an even further embodiment, the security portion can be a modular unit constructed of a theft-impeding material such as steel or a tough plastic. This unit can house the platform, security member, gas spring and stabilizing assembly. It also can be configured to easily fit within a cabinet or enclosure shell that includes a display portion having one or more windows. With this modular construction, the unit can be joined with any compatible cabinet or enclosure, thereby allowing the appearance of the cabinet or enclosure to be updated or periodically modified.

The present invention provides a simple and efficient display case that is resistant to theft. With the gas spring actuator, the platform can be easily raised and lowered. The stabilizing mechanism reduces and/or eliminated platform teetering, thereby preserving the position of items on the platform, as well as preventing binding between the platform and the walls of the security portion. In turn, this reduces wear on the actuator and the display case. When utilized, the various security members and locking members provide enhanced security for the display case.

These and other objects, advantages and features of the invention will be more readily understood and appreciated by reference to the detailed description of the invention and the drawings.

DETAILED DESCRIPTION OF THE INVENTION

I. Overview

Figure 1:
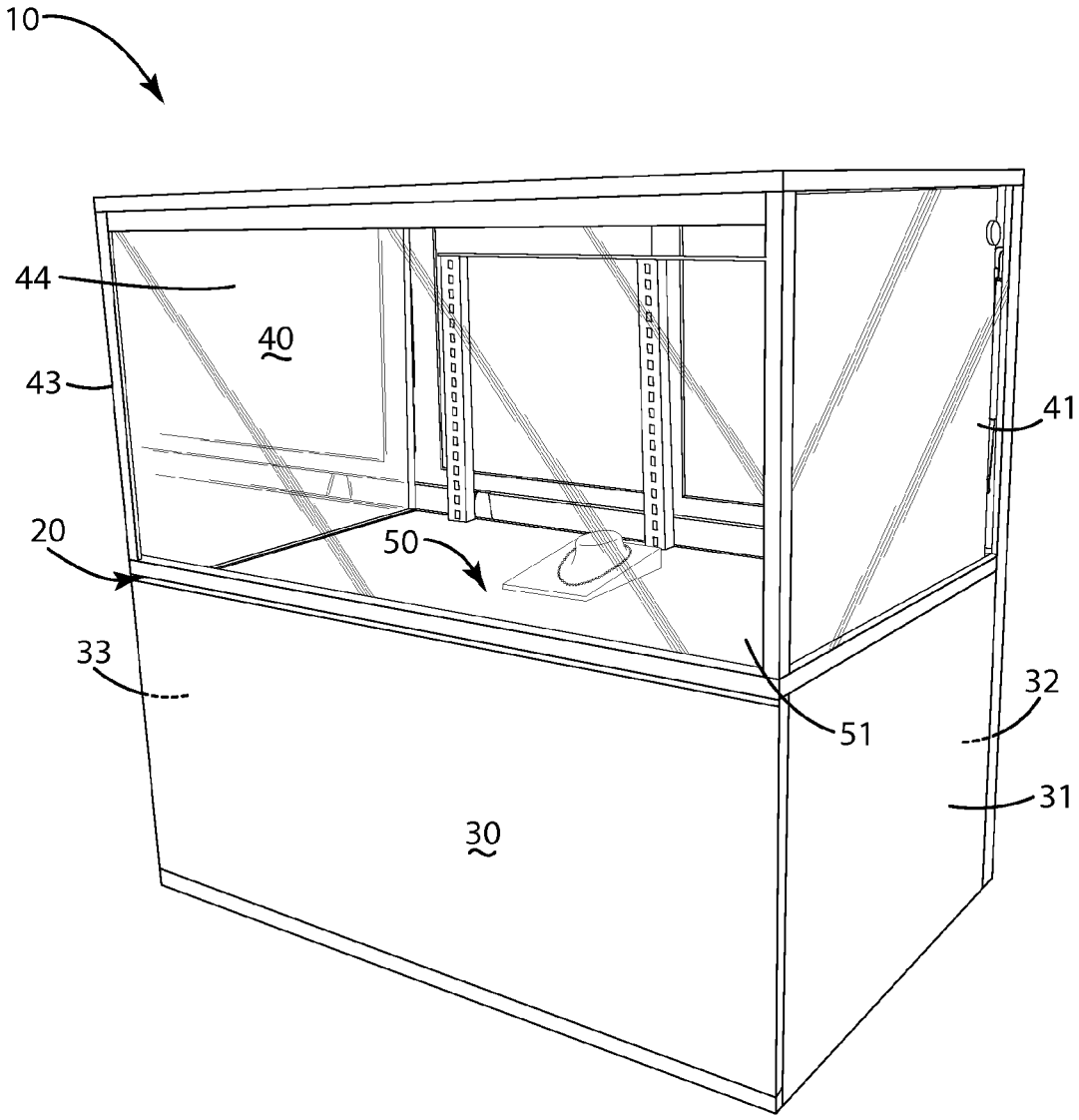
FIG. 1 is a perspective view of one embodiment of a security display case having a platform positioned in a display portion of the security display case.
Figure 2:
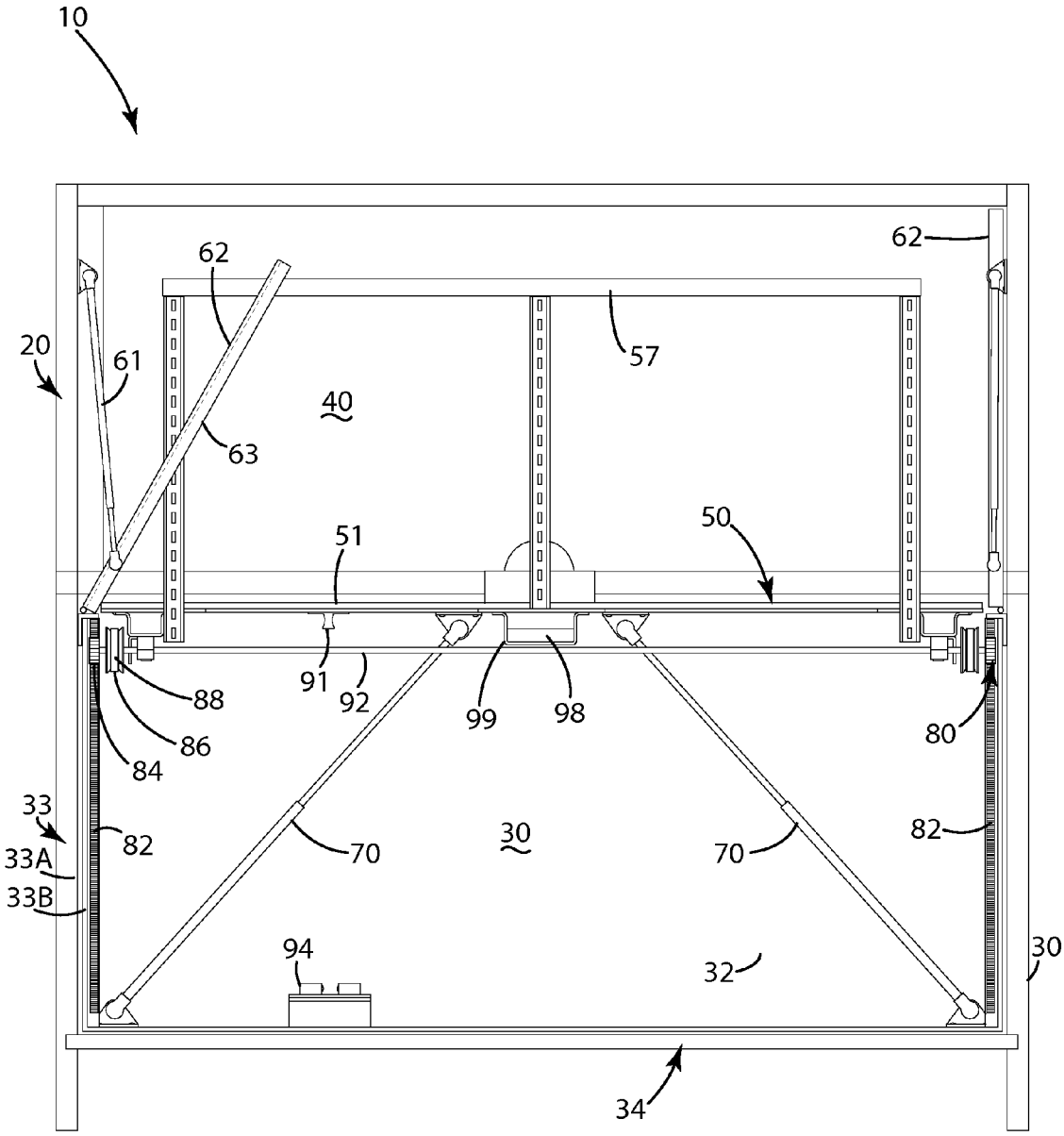
FIG. 2 is a front elevation view of the security display case having the platform positioned in the display portion, with the front portion of the case removed.
Figure 3:
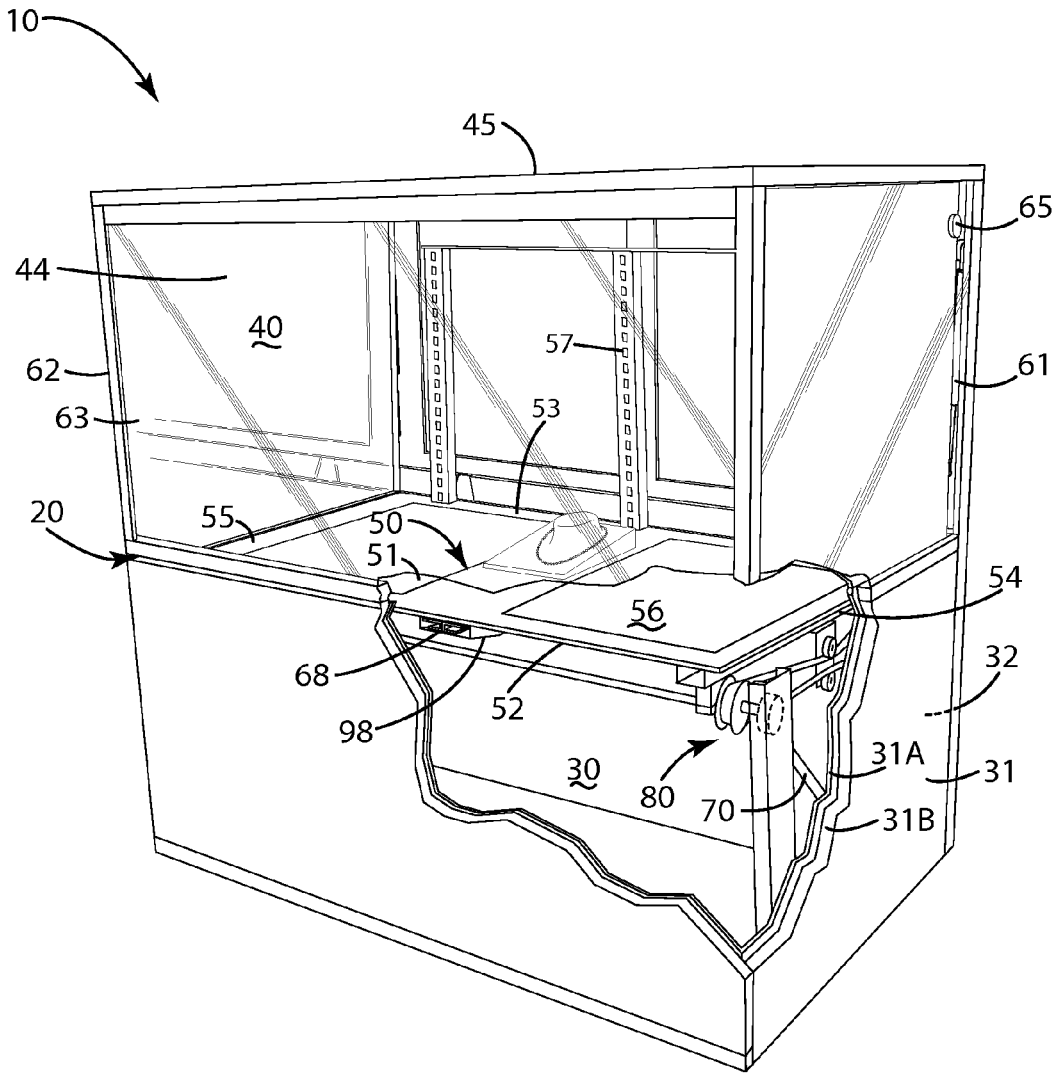
FIG. 3 is a broken perspective view of the security display case having the platform in the display portion, and a portion of a stabilizing mechanism exposed.

A security display case in accordance with an embodiment of the present invention as shown in FIGS. 1-3 and generally designated 10. The security display generally includes an enclosure 20 having a security portion 30, a display portion 40, a platform 50 movable from the security portion to the display portion, and a security member 60 that secures the security portion. At least one gas spring actuator 70 moves the platform from the security portion to the display portion. The case further includes a stabilizing assembly or mechanism 80 that stabilizes the platform as it moves between the security portion and the display portion.

In operation, a user manually presses the platform so that a gas spring actuator is "reset" to an extension mode, which is initiated by the manual engagement. In the extension mode, the gas spring extends and simultaneously pivots relative to the platform 50 and the security portion 30, sweeping through part of the security portion 30. During extension, the gas spring 70 moves from a substantially horizontal position, in which the spring is generally un-extended, to an angle relative to the horizontal, in which the spring is generally extended. Where two gas spring actuators are included in opposing relation, the lateral forces generated by each spring are cancelled to a certain degree, and the vertical forces are combined, to efficiently lift the platform 50 from the security portion 30 to the display portion 40. Further, when the platform 50 is to be moved to the security portion 30, a user simply presses down on the platform 50 to move it to the security portion 30, at which point the gas springs achieve a locked mode so that they do not generate enough force to raise the platform 50. In addition, an optional latch can be included to further secure the platform in the security portion.

II. Construction

The components of an embodiment the security display case 10 will now be described in more detail with reference to FIGS. 1-4. As shown in FIG. 1, the display case enclosure 20 includes a display portion 40 and a security portion 30 below the display portion. There, the platform 50 is raised so that items thereon can be viewed in the display portion 40.

The security portion 30 is defined by multiple interconnected walls 31, 32, and 33. Another wall is usually secured to the rear of the security portion 30 to fully enclose that portion; however, as shown in multiple figures, that wall is removed to more clearly show the internal components of the display case 10. A floor 34 is located below the security portion 30. The floor 34 can be mounted on a base or other structure as desired. Although shown in a generally box-shaped form, the walls and floor of the security portion can be configured in any desired geometric construction, for example, a cylinder, a pyramid, a sphere or other configuration as desired.

The walls 31-33 and floor 34, as well as the platform 50 can be constructed from wood, wood laminate, wood composite, plastic, fiberglass, metal or the combination of these materials as the application requires. As further illustrated, the walls 31-33 and floor 34 can include an outer panel 31A, 33A and a security liner panel 31B, 33B. The outer panel 31B, 33B can be constructed from an aesthetically appealing material, such as wood, plastic and the like, while the liner panel 31A, 33A can be constructed from a material, such as metal, composites, fiberglass and the like, that is resistant or impervious to undesired tampering or attempts to access the interior of the security portion without authorization. Indeed, multiple liner panels can optionally be combined to construct a modular security portion as described below in another embodiment.

The display section 40 can include walls 41 and 43, which as shown, can be continuations of the security portion walls 31 and 33, respectively. The display portion 40 also optionally includes one or more panels 44, which further enclose that portion. These panels can be transparent. This enables a customer to view items displayed on the platform. In addition, the upper wall or top 45 of the display portion 40 can be constructed of glass or other similar transparent materials such as tempered or laminated glass or plastic. The display section 40 can also include lighting components (not shown) to illuminate the platform and provide customers with a better view of items placed on the platform 50.

Figure 9:
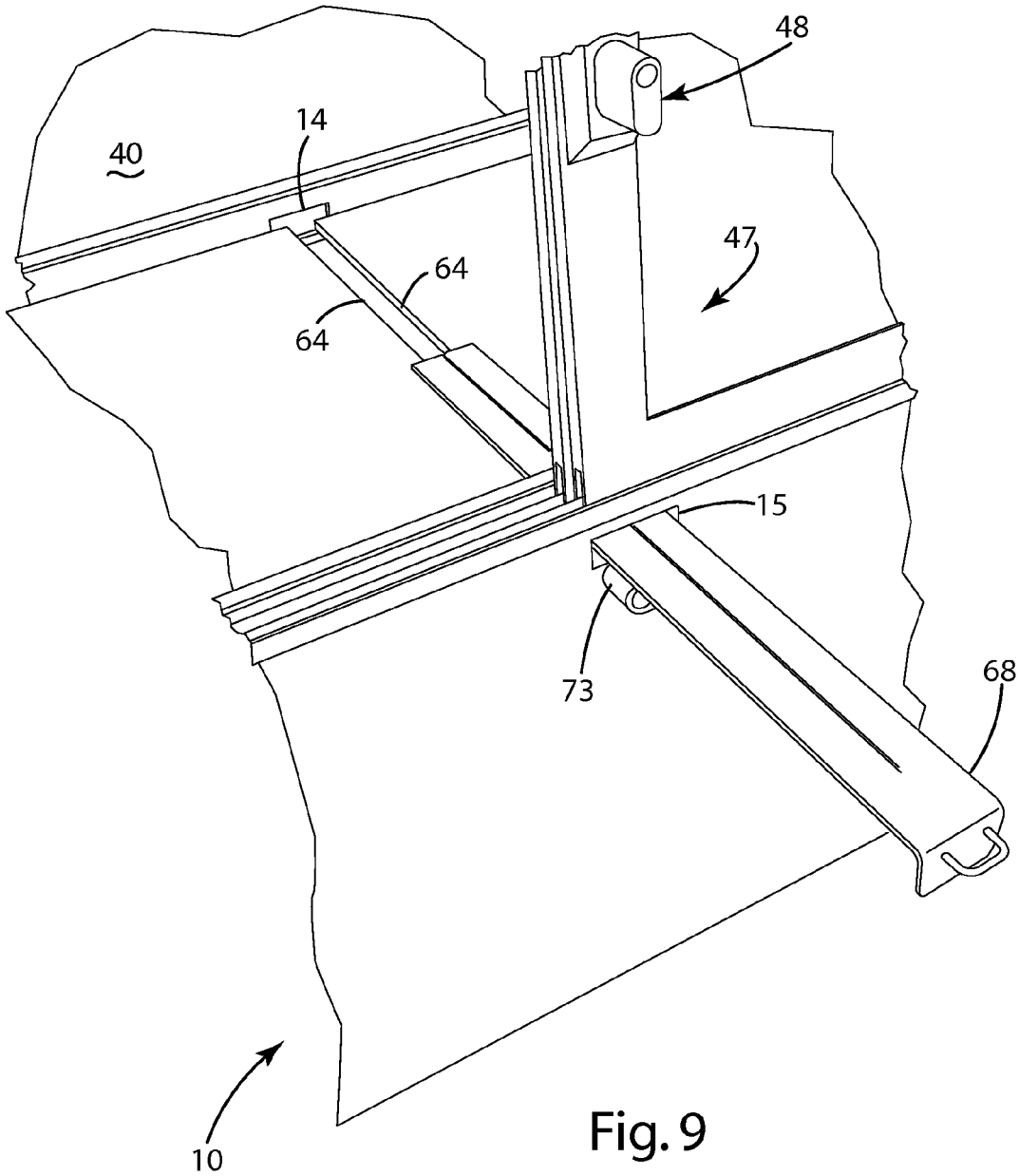
FIG. 9 is a perspective view of the lock member partially engaged with the security member of the display case.

In addition, as shown in FIG. 9, the rear portion of the display section 40 can include access doors 47, which can include a conventional lock 48 to provide security for items when the platform is in a raised position as shown in FIG. 1. Although the access doors are shown as sliding doors, they may be constructed in any desired configuration, for example, they may be hinged to the case 10, or may be completely removable as the application requires.

Figure 4:
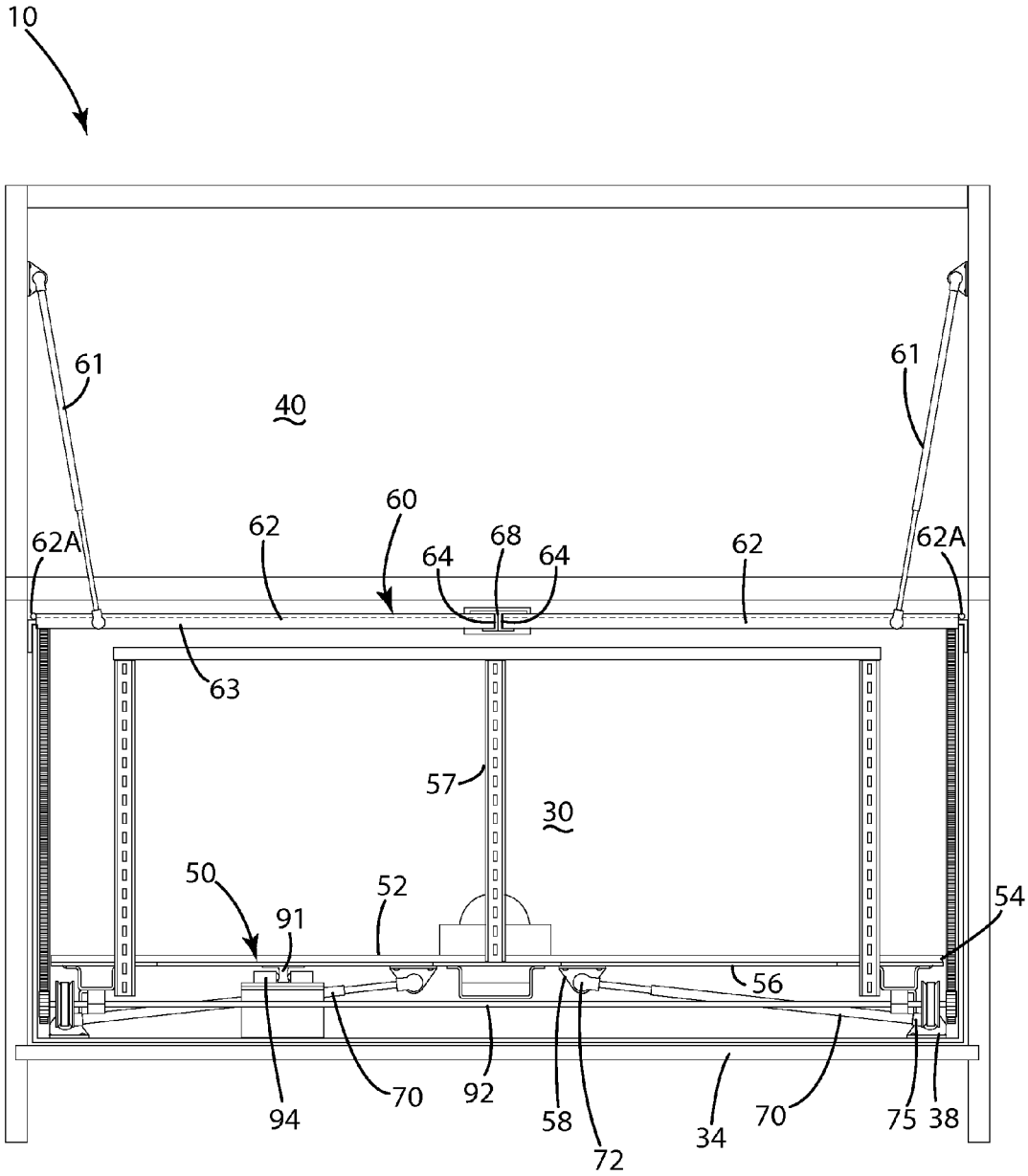
FIG. 4 is a front elevation view of the security display case having the platform positioned in the security portion, with the front portion of the case removed, and doors of the case closed.

The display case 10, as shown in FIGS. 2-4, can also include an optional security member 60 selectively positionable between the display portion 40 and security portion 30. This security member can include doors 62, secured with hinges 62*a* to the case 10. The doors 62 can be configured to fold downward over and partially or wholly conceal the security portion 30, and thus any valuables on the platform. Although shown folding in from the sides of the case, the doors alternatively can be configured to fold in from the front and/or back of the case, or any other portion of the case as the application requires. Further, the security member need not include folding doors, rather, the doors can slide over the security portion 30, or can be substituted with a single door that simply slides through a slot in the side of the enclosure (not shown) over the security portion 30. Alternatively, the case can include a tambour closure (not shown) as desired to secure the security portion 30.

Returning to the security member 60 shown in FIGS. 2-4, the undersides of the doors may include mirrors 63 to provide yet another view of the items placed on the platform 50, and generally provide the perception that the security portion is larger than it really is. Further, the security member can include door dampening springs 61, of the type that slows closure of the doors so that the doors do not slam closed. These door dampening springs 61 can be secured to the doors in any desired location. As shown, the door dampening springs are located entirely above the doors 62, and connected to a rear portion of the doors so that they retract to an retracted state while the doors open, as shown in FIG. 2. The dampening springs can also be located so that when the door attains an open position, the door dampening spring is concealed in a corner of the display section as shown in FIG. 3. Of course, the door dampening spring can be replaced with any device that assists in opening or closing the door, or can be absent from the security member altogether.

The security member can also optionally include a construction that holds the doors 62 in an open position. For example, the security portion can include a magnet 65 positioned adjacent an open door 62. The door 62 can include a metal component that is attracted by the magnet 65 so as to hold the door open. The magnet construction can be replaced with a latch, or any other device desired to hold the doors 62 open. Of course, the gas springs may be programmed so that they exert enough force to keep the doors 62 open without any devices, or alternatively, the doors may be configured to simple rest in an open configuration without the need for additional devices.

The doors 62 can be constructed of any material such as wood, metal, fiberglass and/or plastic. Optionally, they are constructed from wood and metal to provide added security to the contents stored in the security portion 30 of the display case.

Referring now to FIGS. 1-3, the display case platform 50 is selectively positionable in or adjacent the display portion 40 and/or the security portion 30. The platform 50 includes an upper surface 51, a front 52, a rear 53, the first side 54 and a second side 55. The upper surface 51 can be configured as a separate cover as well (as further shown in FIG. 6), and this cover can be configured to cover access holes 56 defined by the platform so that assemblers can reach the display case components under the platform 50 for repair or maintenance. As shown further, the platform 50 is sized so that the tolerances between the front rear, first side, second side, and the respective walls of the security portion 30 are tight, and typically between about 1/32 of an inch and about 1/2 of an inch, although other tolerances may be chosen as the application requires.

The platform 50 can optionally include a display rack 57. This rack 57 can be configured to support additional shelves or other support structures for merchandise on or above the platform. Generally, the rack is dimensioned so that it fits cleanly under the security member 60 when the platform is in the security portion 30.

Figure 5:
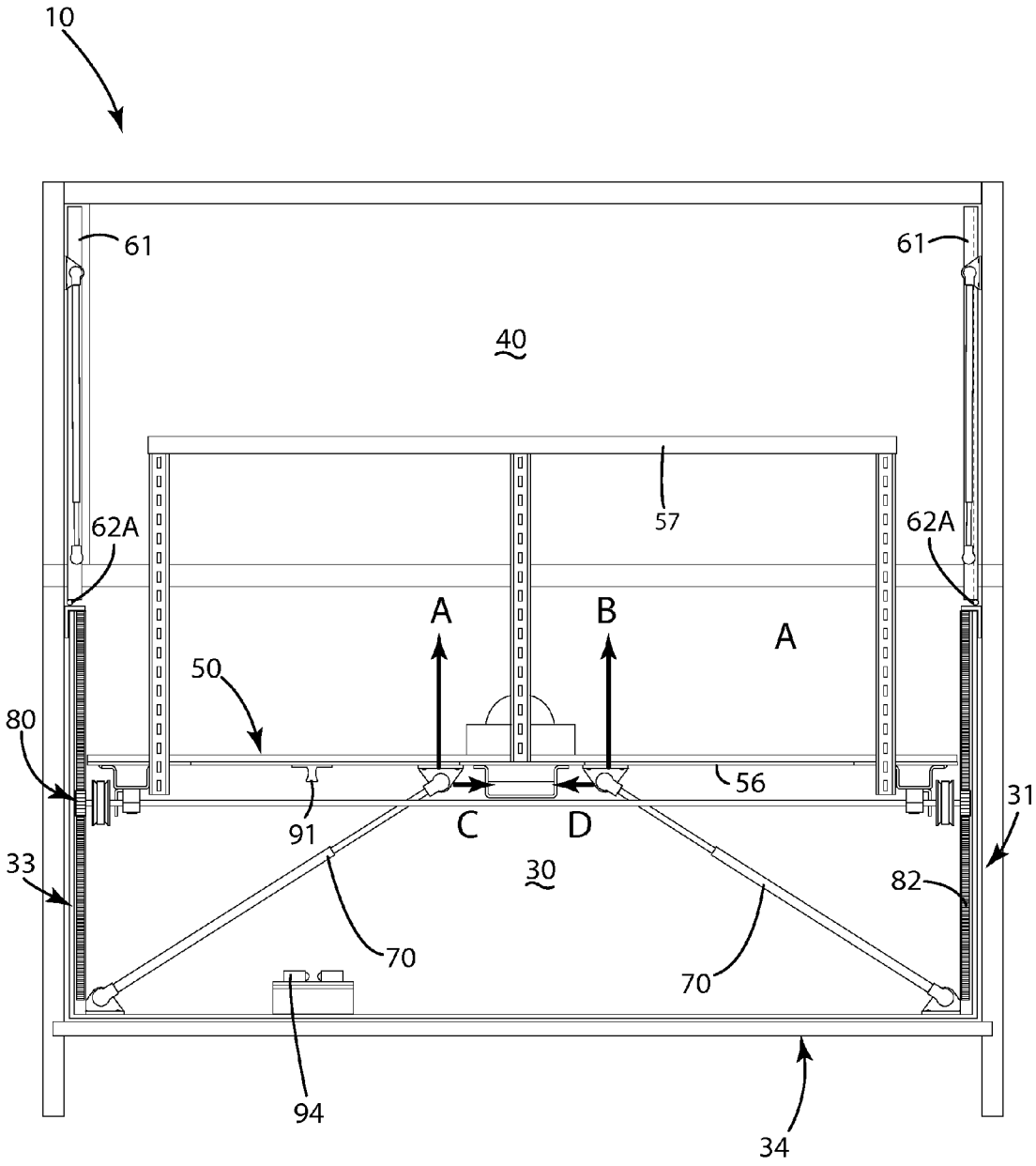
FIG. 5 is a front elevation view of the security display case having the platform transitioning from the security portion to the display portion, with the front portion of the case removed.

The platform 50 also may include a latch system that secures the platform in the security portion 30. As shown in FIGS. 4-5, this latch system can include a first latch portion 91 joined with the platform 50, and a corresponding latch portion 94 joined with the floor 34 of the enclosure. The first latch portion 91 can engage the corresponding latch portion 94 as shown in FIG. 4 to temporarily counter the first and second vertical forces of the gas springs and hold the platform in the security portion 30. The latch system can be deactivated so that the platform can move by a user depressing the platform 50. A variety of other latch and securing mechanisms are suitable to secure the platform if desired.

FIGS. 1-5 illustrate various positions of the platform within the security case. For example, FIGS. 1-3 show the platform 50 in a raised position so that any items supported thereon are visible in the display portion 40, particularly through the glass panel 44. FIG. 3 illustrates the platform 50 in a lowered position, within the security portion 30. FIG. 3 illustrates the platform 50 as it is transitioning from a lowermost position in the security portion 30 toward the display portion 40, or vice versa.

The components of the display case 10 which provide the force to raise and/or facilitate lowering of the platform 50 are the gas spring actuators 70. Each gas spring actuator 70 can be a conventional gas spring that provides controlled motion and force for moving the platform 50. Such gas springs rely on fluid dampening of a gas such as nitrogen in the cylinder. Such gas springs may also include an amount of oil or other liquid in addition to a gas which one selectively transferred between internal chambers defined by the gas spring. A suitable gas spring for use with the present display case is a Suspa Model C16-26067 gas spring available from Suspa, Inc. of Grand Rapids, Mich. Other types of gas or liquid springs or shocks that extend and/or retract in a controlled manner may be used as desired.

Generally, each gas spring 70 can be set up as an extension gas spring, wherein the shock absorption or dampening occurs in the extension direction. When set up this way, the gas spring does not catapult the platform 50 to the display section to encounter a rapid deceleration, which could upset items placed on the platform. Optionally, the gas spring 70 can be outfitted with an internal valve or other adjustable configuration that enables a user to fine tune the desired dampening, either continuously or in discrete settings.

The gas springs also can be set so that they lock in place when they are in an unextended state FIG. 4 and the platform 50 is in the security portion 30 of the display case 10. To reset or unlock the gas springs 70 so that they can extend, each gas spring need only be lifted slightly, for example, by a user initially lifting the platform 50 slightly with a small force.

Alternatively, to reset or unlock the gas springs for extension, the gas springs 70 can be depressed slightly. This can be achieved, for example, by a user depressing the platform 50 downward a slight distance with minimal force of about 1 to about 10 pounds of force. After such lifting or depression, each gas spring 70 is unlocked and begins its extension stroke, thereby moving the platform 50 up and toward the display section 40. Optionally, the gas springs can be without an internal locking mechanism. In such a construction, the platform or enclosure can include an independent locking mechanism, such as the latch noted above. Of course, the latch system can also be used with gas springs having an internal locking mechanism as the application requires.

Figure 8:
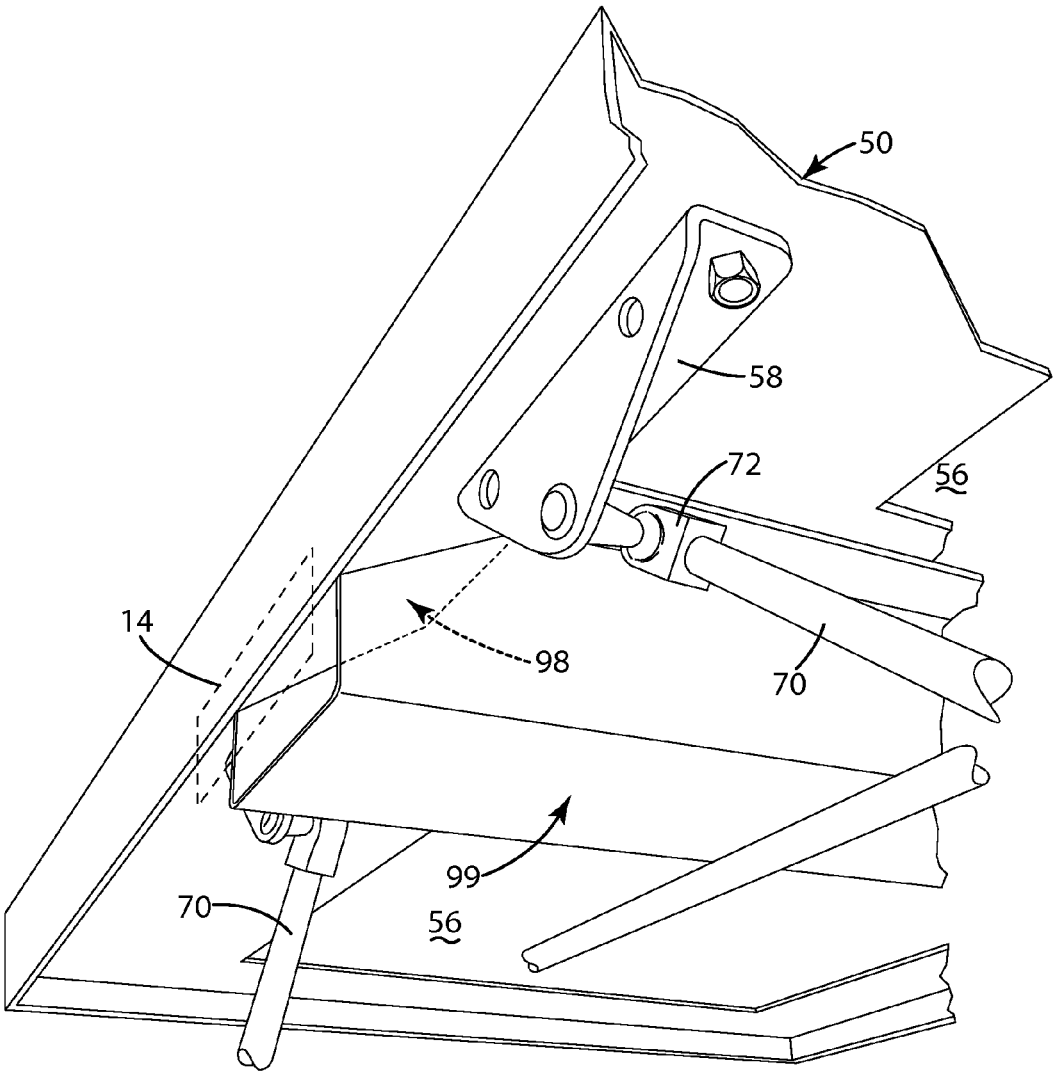
FIG. 8 is a perspective view of the underside of the platform and a locking member guide bracket.

Each gas spring 70, in particular, the first end 72 thereof, can be non-rigidly secured to the platform 50 via a bracket 58 that enables the gas spring to pivot relative to the bracket 58. As shown in FIG. 8, this pivoting capability can be achieved with a ball and socket connection. Other types of pivoting connections, such as an axle fitted through a corresponding cylindrical bore, or a cam like connection can be used as well. The second end 75 of the gas spring 70 can be pivotally and non-rigidly secured to the security portion 30, e.g., the floor 34, via another bracket 38 as well. The brackets 38 and 58 can be fastened in a conventional manner to the platform and/or the security portion or display case as desired.

As shown in FIG. 4, the gas springs 70 are configured in directly opposing relationship when the platform 50 is at rest in the security portion 30. There, the gas springs are in substantially horizontal position in their unextended state. Referring to FIG. 1, however, where the gas springs 70 are in their extended mode, each gas spring is at an angle relative to horizontal. Although the angle of the gas springs in their extended state is shown at about 30 to about 50 degrees, it can vary anywhere from about 10 to about 90 degrees depending on the application.

As each gas spring 70 extends in the security portion 30 below the platform, each sweeps across and through a volume of the portion. Therefore, it is suitable to place a gas spring 70 in a location where it will not collide with or be hindered by items or structures of the display case under the platform 50. As shown in FIG. 4, the gas springs 70 can be located at the rear of the display case 10, adjacent the rear wall so that the gas springs only occupy and sweep through that rearmost portion of the security portion. The gas springs 70 can occupy other portions of the display case 10 under the platform 50, such as the middle of the display case, so that the springs only occupy and sweep through the middle of the security portion as desired. The springs can alternatively or additionally be located in the front of the display case as desired as well. Further, multiple pairs (not shown) of gas springs can be included in the case to move the platform, and, if desired, each spring can be offset a distance (toward the front or back) from its opposing gas spring. Moreover, the orientation of these gas springs optionally can be modified, for example, the brackets 58 can be moved toward the sides of the platform 50, and the brackets 38 can be moved toward the center of the floor 34. Other configurations can be implemented as desired.

With reference to FIG. 5, each gas spring 70 transfers vertical forces A and B to raise the platform 50; however, each gas spring also exerts a lateral force components, for example, forces C and force D on the platform 50. Generally, these lateral forces cancel one another to a certain degree, if not entirely in many cases. Any residual lateral force exerted on the platform caused by one lateral force being greater than the other, or by the forces transferred through the pivot between the platform and spring, can be controlled by the stabilizing mechanism 80 of the display case 10. In certain cases, without the stabilizing mechanism, the platform can be prone to teetering or tilting, or otherwise becoming unlevel and potentially disturbing any items positioned on the surface 51 of the platform. With the stabilizing mechanism, these effects can be minimized.

As shown in FIGS. 4-7, the stabilizing mechanism 80 generally can include an assembly having a rotatable gear coupled to a rack gear, for example, a rack and pinion gear assembly. The racks 82 can be secured to the walls 31 and 33 of the security portion. Optionally, these racks can continue upward into the display portion 40 as desired. The racks 82 can be secured with any conventional fasteners such as screws, nails, rivets, glue and the like.

Each of the racks are toothed to mesh with respective rotatable pinion gears 84, 85. The pinion gears on the same side of the platform, for example, the pinion gears 84 and 85 nearest the wall 31, are synchronized so that they rotate at substantially the same rate and assist in keeping the platform level as it is raised. As an example, each pinion gear 84 and 85 is associated with a corresponding pulley 86 and 87, and further joined with corresponding axles 92 and 93, respectively. The pinion gear 84 and pulley 86, as well as the pinion gear 85 and 87, can be non-rotatable relative to one another. The pulleys 86 and 87 can be joined by a synchronizing member 88. The pulleys and synchronizing member can be smooth, or optionally textured to enhance engagement between these components. For example, the pulleys can be toothed to mesh specifically with the synchronizing member 88 and prevent any slippage between the pulleys and the synchronizing member 88. In this manner, the front and rear of the platform can be raised by the actuators 70 and lowered in a substantially level manner. Optionally, the synchronizing member is shown as a toothed belt, but can be any other continuous loop member, such as a cord, a rope, a web, a string, a wire and the like.

Figure 6:
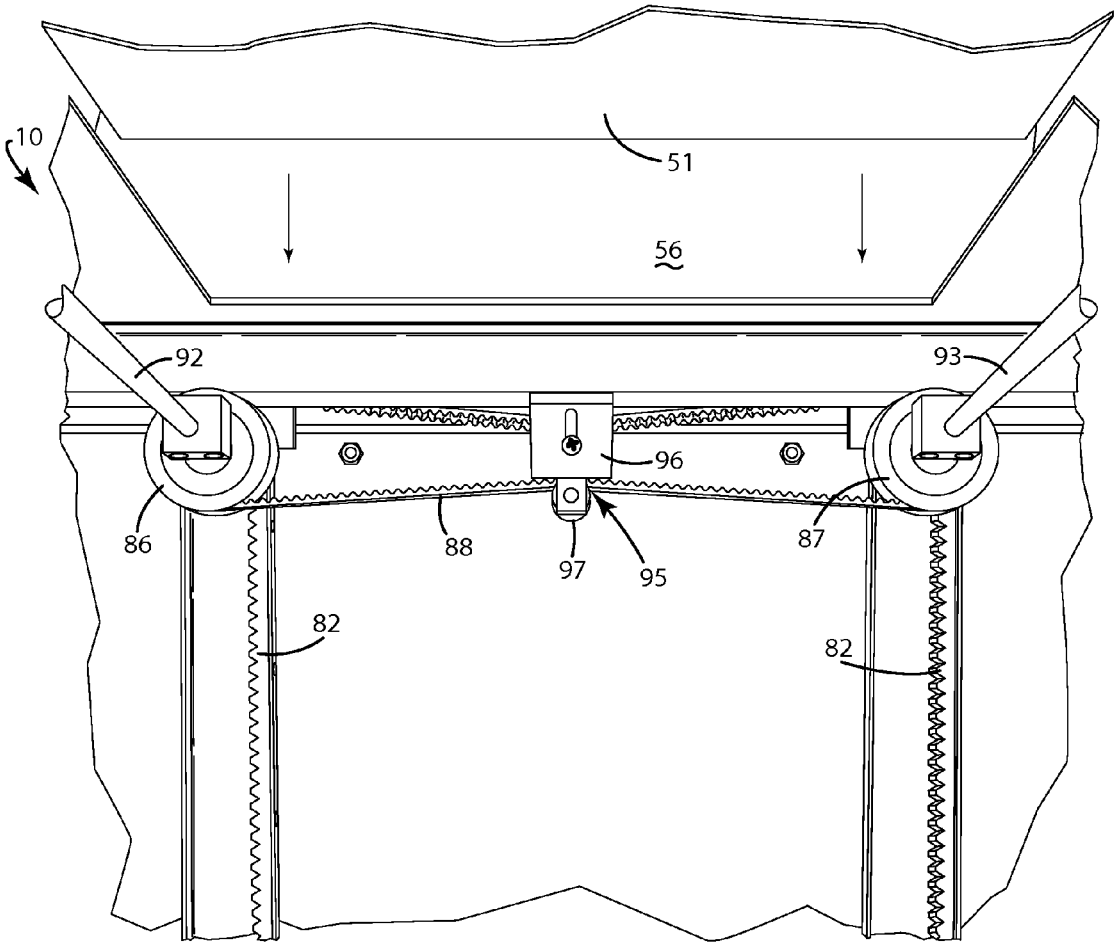
FIG. 6 is a perspective view of a stabilizing mechanism of the case, with a platform cover partially removed and the platform in the display portion.
Figure 7:
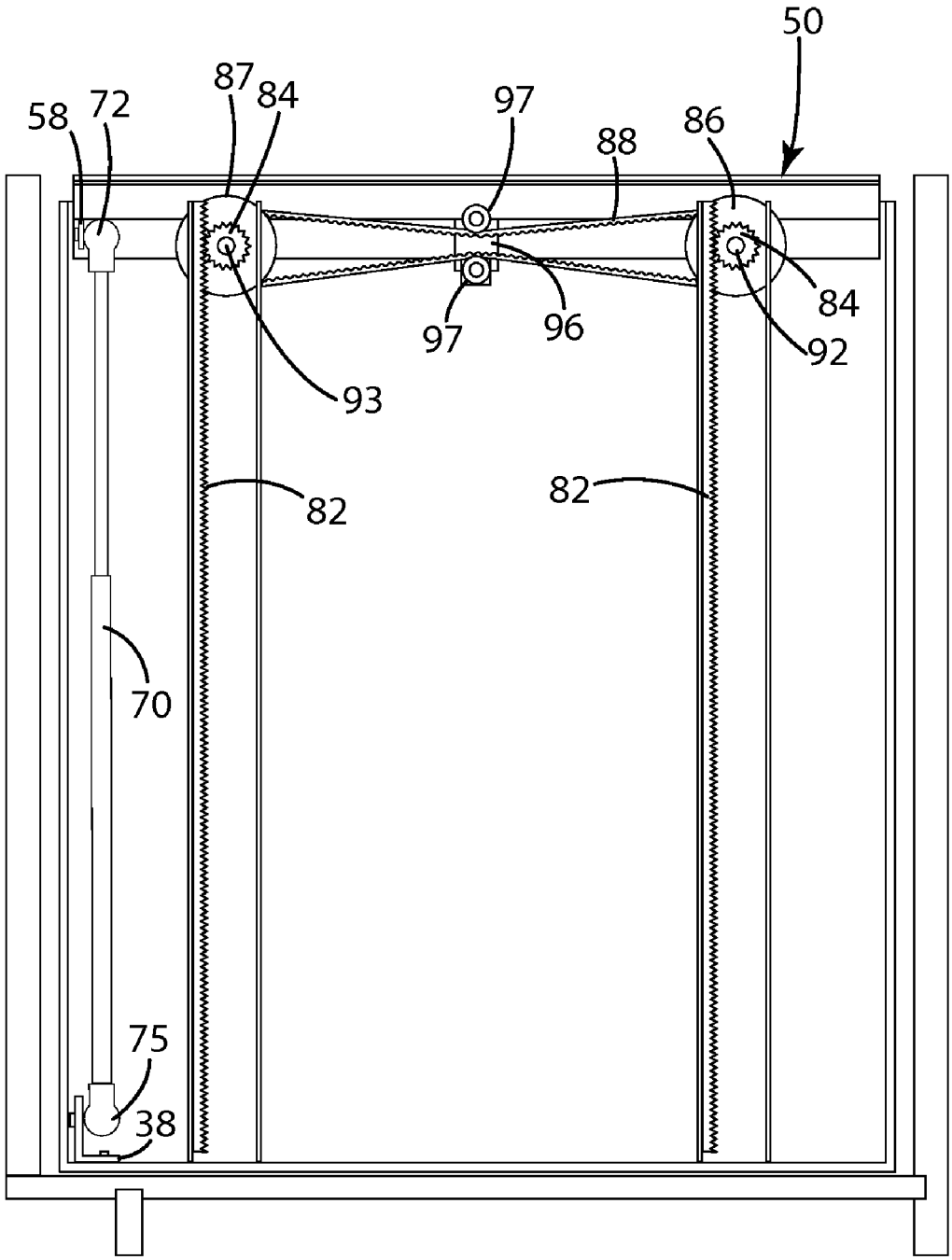
FIG. 7 is an elevation view of the stabilizing mechanism of the case, with the platform in the display portion.

Optionally, the synchronizing member 88 can be placed under tension by one or more tension members 95. These tension members can be positioned adjacent the synchronizing member 88 as shown in FIGS. 6 and 7. The tension member can include at least two members 97 that engage and tension the synchronizing member. These members 97 can be wheels mounted to a bracket 96. The wheels 97 themselves can be mounted to a secondary bracket (not shown) that is moveable relative to the bracket 96 and thus the platform to precisely position the wheels relative to the synchronizing member 88 and provide the desired amount of tension.

A second rack-in-pinion gear assembly, which generally mirrors the assembly described immediately above and shown in FIGS. 6-7 can be positioned on the opposite side of the platform 50. The second gear assembly can be joined with the first gear assembly on the opposite side via the axle rods 93 and 92. In this manner, the pinion gears in all four corners of the display case 10 can track in their respective rack gears in a synchronized manner. With the gear assemblies at opposite sides of the display case being synchronized, the platform can further be controlled so that it raises and lowers in a substantially level manner, and is resistant to tipping. This further prevents collision or rubbing of the sides or front or rear of the platform 50 with the walls of the security portion 50. Accordingly, the stabilizing mechanism guides the platform 50 in a substantially consistent manner so that the platform maintains a predetermined level relative to horizontal and distance between each of the respective walls of the security portion and/or display case.

Figure 10:
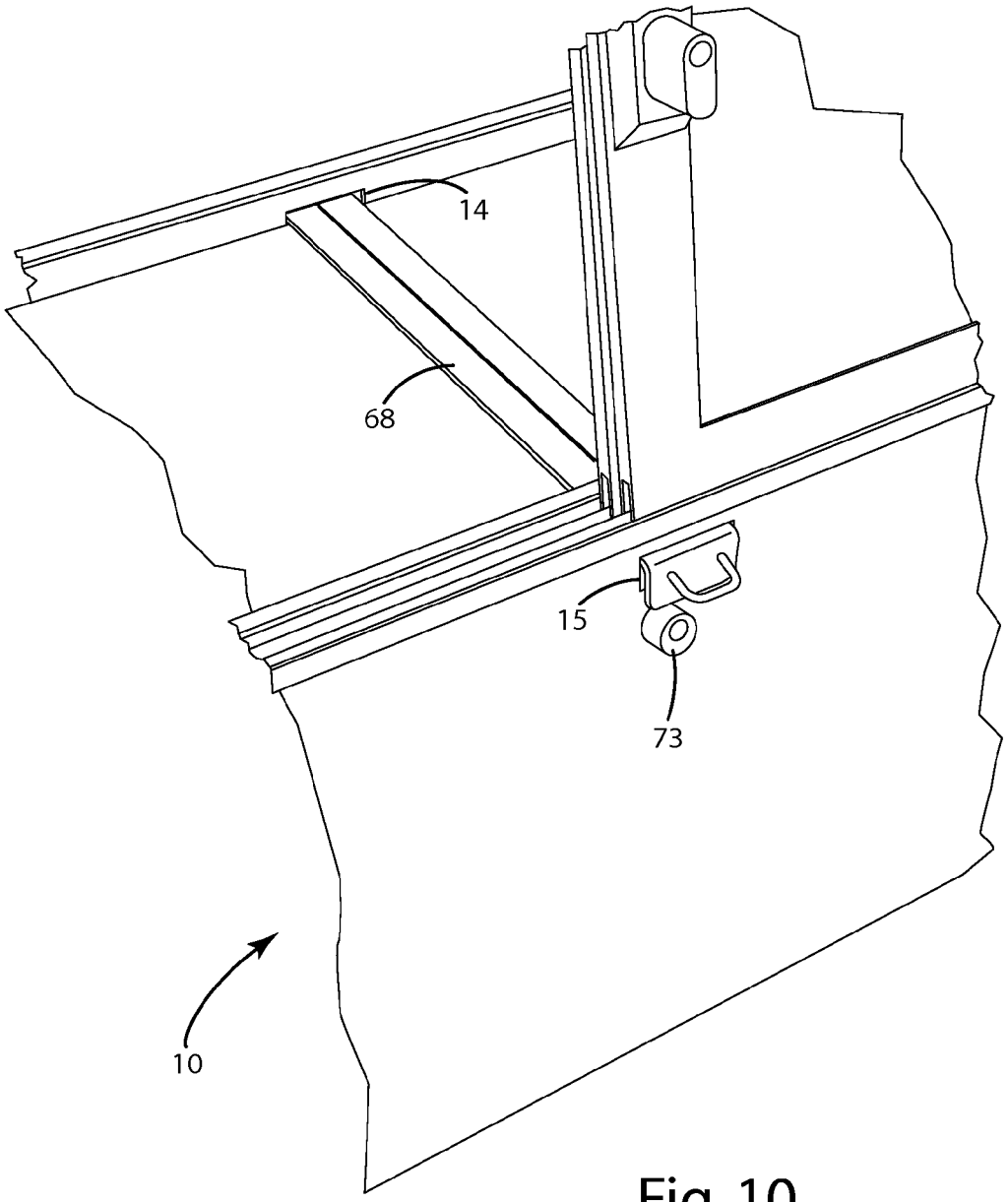
FIG. 10 is another perspective view of the lock member platform fully engaged with the security member.
Figure 11:
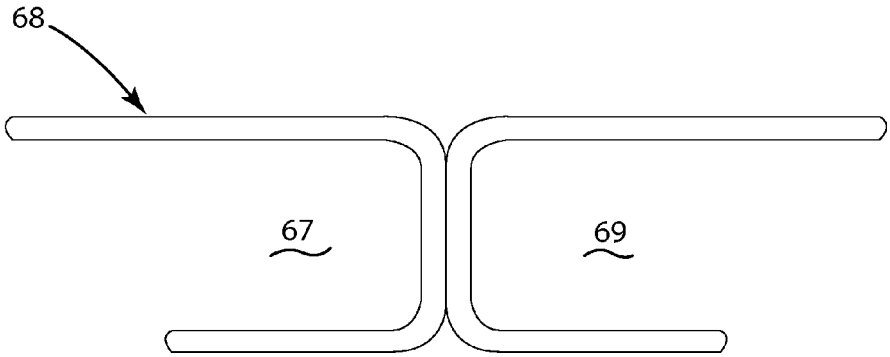
FIG. 11 is an end view of the lock member.

As shown in FIGS. 4 and 9-11, the display case 10 optionally includes a security member 60 having doors 62 that lock in a closed position with a locking member 68. In this optional construction, the inward edges 64 of the doors 62 close in a manner so that they are immediately adjacent one another in a central or other location of the display case. The walls of the security portion 130, and optionally, certain liner panels, can define apertures 14 and 15 that are generally aligned with the edges 64 of the door. The locking member 68 can interact with the doors 62 to lock them in a secured position. As illustrated in FIG. 11, this locking member 68 can include opposing channels 67 and 69 that are generally C-shaped and open away from one another.

As shown in FIGS. 9 and 10, when inserted through the apertures 14 or 15, the C-channels capture the edges 64 of the respective folding doors 62 of the security member 60. Referring to FIG. 13, the locking member can be of sufficient length so that when it is inserted, it extends through both the aperture 14 and opposite aperture 15 so that the doors 62 are resistant to prying. Optionally, the locking member 68 can include a locking portion. The locking portion can be outfitted with a lock 73 that locks the locking 68 in place so that the doors remain secured.

A variety of other conventional locking devices can be used to lock the doors 62. For example, one of the doors may include a keyed mechanism that rotates a plate into a slot defined by the other door (not shown), or, where the security member is a tambour design (not shown), the end of the tambour may include a keyed mechanism to hold that end in a fixed location (not shown) relative to the case.

As shown in FIGS. 2, 3 and 8, the platform 50 can optionally include a locking member guide bracket 99 which, when utilized with the locking member 68, can provide additional safety features when the platform 50 is in or adjacent the display portion 40 of the case. For example, when the platform is in these positions, the locking member guide bracket 99 can align with the apertures 14 and 15 in the sides of the security portion. Accordingly, as shown in FIGS. 3 and 8, the locking member 68 can be placed though each of these apertures to secure the platform 50. Where the locking member guide bracket 99 includes a centering ramp or surface 98, which can be an inclined or curved surface, that centering ramp assists in quickly and automatically aligning the locking member 68 with the aperture 14 in the security case. Incidentally, the above construction also provides a storage location for the locking member 68 when it is not being used as part of the security member 60 to secure the doors 62 in a closed position as described above.

Figure 12:
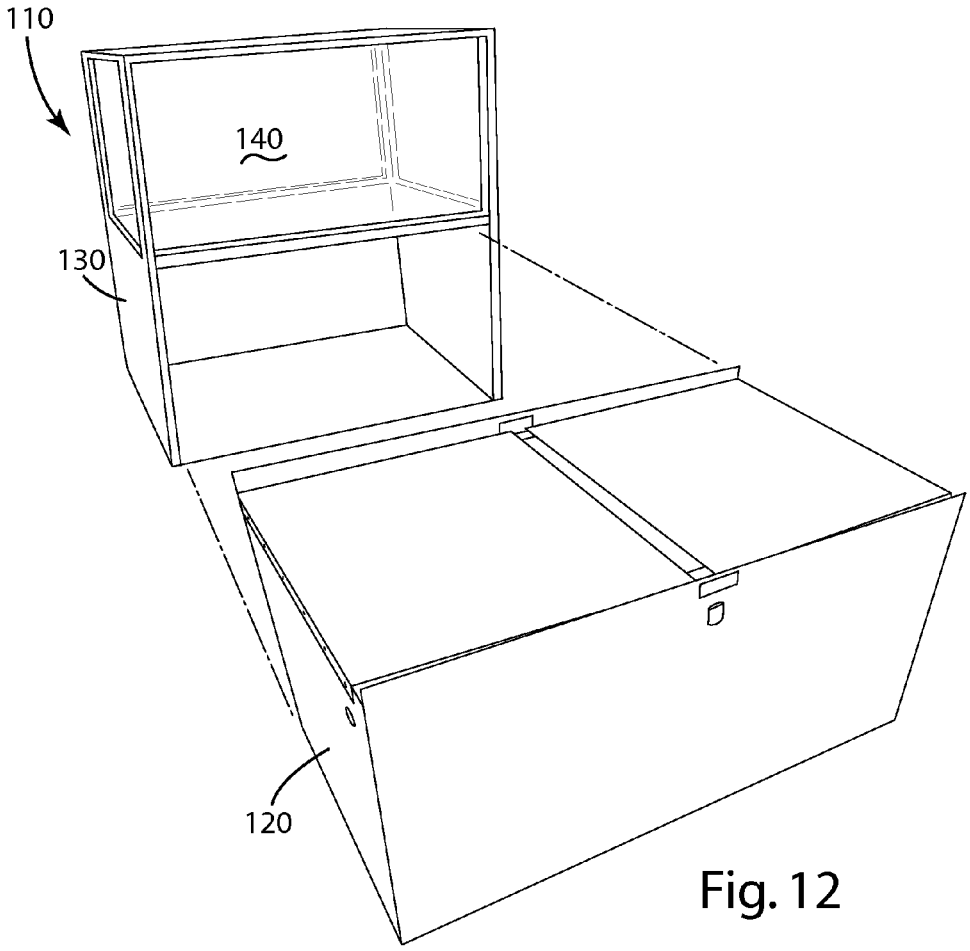
FIG. 12 is a perspective view of a modular embodiment of the display case.

In another embodiment, shown in FIG. 12, the security display case 110 can be of a modular construction. There, a modular security liner case 120, which can include all of the working components described above, for example, the security member, platform, stabilizing mechanism, and the like, is configured to fit within a display case or cabinet 130 that has a decorative exterior surface and also includes a display portion 140. When fitted within the cabinet 130, the security case 120 operates identically to the embodiments described above to raise and lower a platform from a security portion within the modular security liner case to a location where items on the platform are viewable through the display case 130. With this added modularity, the same security case 120 can be used in a variety of different cabinets. Accordingly, the cabinets can be modified or updated. A substantial savings can be realized by removing the modular security case 120 from an old cabinet 130 as shown in FIG. 12 and moving the case to a new or updated cabinet. Finally, although shown as being removable from a side of the display case 130, the display case can be constructed so that the modular security case 120 is removed from the top of the display case. Additionally, the upper walls of the display portion can be removable to facilitate removal of the modular security case 120.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The embodiments of the invention in which an exclusive property or privilege is claimed are defined as follows:

1. A security display case comprising:

an enclosure including a security portion and a display portion, the display portion located above the security portion, the display portion including at least one transparent wall;

a platform positioned within the enclosure, the platform including an exposed surface configured to support items thereon, a front, a rear, a first side and a second side, the platform being moveable between the security portion and to a position where the supported items are viewable in the display portion, the platform being joined with at least two rotatable gears;

a security member selectively positionable between the display portion and the security portion when the platform is positioned in the security portion;

a stabilizing mechanism including at least two rack gears joined with the enclosure, the at least two rack gears engaging the at least two rotatable gears joined with the platform, the stabilizing mechanism further including a synchronizing member joined with the at least two rotatable gears, a first gas spring adapted to raise the platform from the security portion upward to the display portion, the first gas spring including a first end and a second end, the first end pivotally joined with the platform, the second end pivotally joined with the enclosure, the first gas spring extendable from a retracted position, in which the first gas spring is substantially horizontal, to an extended position, in which the first gas spring is at an angle to horizontal; and a locking member;

wherein the first gas spring is actuatable by a user manually depressing the platform, the first gas spring generating an upward vertical force to raise the platform from the security portion toward the display portion, the first gas spring pivoting from substantially horizontal to an angle relative to horizontal as it vertically raises the platform, wherein the at least two rotatable gears engage the corresponding at least two rack gears and rotate passively in response to an upward movement of the platform relative to the at least two rack gears as the first gas spring vertically raises the platform, wherein the synchronizing member synchronizes the rotation of the at least two rotatable gears so that the stabilizing mechanism prevents binding of the platform with the security portion as the first gas spring raises the platform, whereby the platform is raised in a substantially level manner, wherein the security member includes a pair of opposing doors, each door pivotally connected to the enclosure, each door including an opposing edge, each opposing edge located adjacent one another when the doors are in a closed position to conceal the security portion, wherein the enclosure defines an aperture that is aligned with the opposing immediately adjacent edges of the doors when the doors are in the closed position, wherein the enclosure includes a central portion, wherein the opposing immediately adjacent edges are positioned substantially within the central portion of the enclosure when the doors are in the closed position, wherein the locking member is adapted to be positioned through the aperture and to engage each of the opposing immediately adjacent edges to prevent the doors from being opened from the closed position, wherein the locking member is an elongate bar including opposing immediately adjacent C-shaped channels, each C-shaped channel opening in a direction generally opposite and away from each other, each channel capturing one of the opposing immediately adjacent edges of the doors when the locking member is positioned through the aperture.

2. A security display case comprising:

an enclosure including a security portion and a display portion, a platform moveable from the security portion toward the display portion;

a security member selectively positionable between the display portion and the security portion so that the security portion is at least partially concealed;

a stabilizing mechanism void of any power supply including a rack and pinion gear assembly joined with the security portion and the platform, the rack and pinion gear assembly including at least two pinion gears engaged by a common synchronizing member;

a gas spring adapted to raise the platform from the security portion to the display portion, the gas spring including a first end and a second end, the first end pivotally joined with the platform, the second end pivotally joined with the security portion, the gas spring configured to generate a force to raise the platform from the security portion toward the display portion, the gas spring pivoting from substantially horizontal to an angle relative to horizontal as it raises the platform, the gas spring exerting a vertical, upward force on the platform throughout a complete range of movement of the gas spring and at all times during the pivoting of the gas spring, wherein the synchronizing member synchronizes passive rotation of the at least two pinion gears to prevent binding of the platform with the security portion as the gas spring raises the platform, wherein the security member includes two doors that fold inward toward one another to close and conceal the security portion, each of the doors including an opposing end, each opposing end being adjacent one another when the doors are closed, wherein the security member includes a lock member comprising two C-shaped channels opening in a direction generally opposite and generally away from each other and wherein the security portion defines an aperture, the lock member adapted to slide through the aperture and lock the opposing immediately adjacent ends of the two doors when the doors are closed.

3. The security display case of claim 2 wherein the platform is raised only by the gas spring.

4. A security display case comprising:

an enclosure including a security portion and a display portion, a platform moveable from the security portion toward the display portion;

a security member selectively positionable between the display portion and the security portion so that the security portion is at least partially concealed;

a stabilizing mechanism void of any power supply including a rack and pinion gear assembly joined with the security portion and the platform, the rack and pinion gear assembly including at least two pinion gears engaged by a common synchronizing member;

a gas spring adapted to raise the platform from the security portion to the display portion, the gas spring including a first end and a second end, the first end pivotally joined with the platform, the second end pivotally joined with the security portion, the gas spring configured to generate a force to raise the platform from the security portion toward the display portion, the gas spring pivoting from substantially horizontal to an angle relative to horizontal as it raises the platform, the gas spring exerting a vertical, upward force on the platform throughout a complete range of movement of the gas spring and at all times during the pivoting of the gas spring, wherein the synchronizing member synchronizes passive rotation of the at least two pinion gears to prevent binding of the platform with the security portion as the gas spring raises the platform, at least two tension members, wherein the stabilizing mechanism includes a second rack and pinion gear assembly, the second rack and pinion gear assembly including at least two additional pinion gears engaged by a second common synchronizing member, each of the at least two pinion gears joined with a respective one of the two additional pinion gears by an axle spanning across a portion of the security portion, wherein each of the joined pinion gears forms a set, wherein each set of pinion gears and the axle connecting the set of pinion gears rotate about a single axis of rotation, wherein the synchronizing members each include a belt, wherein one of the tension members is adjacent each of the belts, the tension members each including a bracket joined with the platform and a wheel movably mounted to the bracket.

* * * * *